US009739559B2

(12) United States Patent
Bush

(10) Patent No.: US 9,739,559 B2
(45) Date of Patent: Aug. 22, 2017

(54) SOUND SUPPRESSOR

(71) Applicant: Century International Arms, Inc., Delray Beach, FL (US)

(72) Inventor: Michael D. Bush, Delray Beach, FL (US)

(73) Assignee: Century International Arms, Inc., Delray Beach, FL (US)

( * ) Notice: Subject to any disclaimer, the term of this patent is extended or adjusted under 35 U.S.C. 154(b) by 0 days.

(21) Appl. No.: 14/928,200

(22) Filed: Oct. 30, 2015

(65) Prior Publication Data

US 2017/0102201 A1 Apr. 13, 2017

Related U.S. Application Data

(60) Provisional application No. 62/238,688, filed on Oct. 7, 2015.

(51) Int. Cl.
*F41A 21/32* (2006.01)
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34; F41A 21/36
USPC ..... 89/14.4
See application file for complete search history.

(56) References Cited

U.S. PATENT DOCUMENTS 1,773,443 A * 8/1930 Zygmunt ..... C09B 49/10 89/14.4
1,874,326 A * 8/1932 Mason ..... F01N 1/006 138/DIG. 4
2,503,491 A * 4/1950 Janz ..... F41A 21/30 181/223
3,385,164 A * 5/1968 Hubner ..... F41A 21/30 181/223
3,500,955 A * 3/1970 Werbell ..... F41A 21/30 181/223
3,667,570 A * 6/1972 WerBell, III ..... F41A 21/30 181/223
4,091,892 A * 5/1978 Hehmann ..... G10K 11/172 181/212
4,291,610 A * 9/1981 Waiser ..... F41A 21/30 89/14.4
4,584,924 A 4/1986 Taguchi
4,685,534 A * 8/1987 Burstein ..... F01N 1/00 181/223
4,974,489 A * 12/1990 Fishbaugh ..... F41A 21/30 89/14.4
5,136,923 A * 8/1992 Walsh, Jr. ..... F41A 21/30 89/14.2
5,164,535 A * 11/1992 Leasure ..... F41A 21/30 181/223

(Continued)

*Primary Examiner* — Derrick Morgan
(74) *Attorney, Agent, or Firm* — Wolf, Greenfield & Sacks, P.C.

(57) ABSTRACT

An apparatus and method for suppressing the muzzle gases from a firearm are disclosed. The suppressor includes a shell and a core, the core having a body with first and second stages. The diameter of the first stage is larger than the diameter of the second stage. In some embodiments, the first and second stages of the core body include hollow chambers defined by baffles. The hollow chambers may have a serpentine arrangement.

30 Claims, 6 Drawing Sheets

(56) References Cited

U.S. PATENT DOCUMENTS 5,966,858 A * 10/1999 Curtis ..... F41A 21/32 42/1.14
6,308,609 B1 * 10/2001 Davies ..... F41A 21/30 181/223
6,575,074 B1 * 6/2003 Gaddini ..... F41A 21/34 89/14.4
7,207,258 B1 * 4/2007 Scanlon ..... F41A 21/30 181/223
7,587,969 B2 * 9/2009 Silvers ..... F41A 21/34 181/223
7,594,464 B2 * 9/2009 Dueck ..... F41A 21/30 89/14.2
7,600,606 B2 * 10/2009 Brittingham ..... F41A 21/30 181/223
7,832,323 B1 * 11/2010 Davies ..... F41A 21/30 89/14.4
8,015,908 B2 * 9/2011 Kline ..... F41A 21/30 181/223
8,167,084 B1 5/2012 Moore
8,171,840 B2 * 5/2012 Kline ..... F41A 21/30 181/223
D685,874 S * 7/2013 Andrews, Jr. ..... D22/108
8,505,431 B2 * 8/2013 Hines ..... F41A 21/36 181/223
8,511,425 B2 * 8/2013 Larue ..... F41A 21/30 181/223
8,522,662 B2 9/2013 Presz, Jr. et al.
8,528,691 B1 9/2013 Carmichael et al.
8,776,771 B1 * 7/2014 Yang ..... F42B 12/40 124/71
8,875,612 B1 11/2014 Klett et al.
8,967,325 B1 * 3/2015 Cronhelm ..... F41A 13/00 181/223
8,978,818 B2 3/2015 Proske
9,038,770 B1 * 5/2015 Morrison ..... F41A 21/30 181/223
9,038,771 B1 * 5/2015 Mueller ..... F41A 21/30 181/223
9,086,248 B2 * 7/2015 Young ..... F41A 21/30
9,102,010 B2 * 8/2015 Wilson ..... B23K 26/345
2007/0107590 A1 * 5/2007 Silvers ..... F41A 21/30 89/14.4
2008/0271944 A1 * 11/2008 Brittingham ..... F41A 21/30 181/223
2010/0126334 A1 * 5/2010 Shults ..... F41A 21/30 89/14.4
2010/0180759 A1 * 7/2010 Petersen ..... F41A 21/30 89/14.4
2011/0186377 A1 * 8/2011 Kline ..... F41A 21/30 181/223
2013/0168181 A1 * 7/2013 Wirth ..... F41A 21/30 181/223
2014/0007481 A1 * 1/2014 Torre ..... F41A 21/02 42/76.1
2014/0076136 A1 * 3/2014 Moss ..... F41A 21/24 89/14.1
2014/0157640 A1 * 6/2014 Whelan ..... F41A 21/30 42/75.02
2015/0090105 A1 * 4/2015 Pace ..... F41A 21/30 89/14.4
2015/0101882 A1 * 4/2015 Moss ..... F41A 21/30 181/223
2015/0136519 A1 * 5/2015 Moore ..... F41A 21/44 181/223
2015/0184968 A1 * 7/2015 Fischer ..... F41A 21/30 89/14.4
2015/0260473 A1 * 9/2015 Barney ..... F41A 21/30 89/14.4
2015/0267988 A1 * 9/2015 Sellars ..... F41A 21/30 42/75.02
2015/0285575 A1 * 10/2015 Sclafani ..... F41A 21/30 181/223
2015/0292829 A1 * 10/2015 Pietila ..... F41A 21/30 181/223
2015/0338183 A1 * 11/2015 Salvador ..... F41A 21/30 181/223
2016/0003570 A1 * 1/2016 Tonkin ..... F41A 21/02 89/14.4
2016/0018178 A1 * 1/2016 Johansen ..... F41A 21/30 181/223

* cited by examiner 100
108b
108a
124
120
118
102
118
116
104
110
122
U
X
Y
G
E
Z
Y
Z
Y
Z
Y

SOUND SUPPRESSOR

CROSS-REFERENCE TO RELATED APPLICATIONS

This Application claims priority under 35 U.S.C. §119(e) to U.S. Provisional Application Ser. No. 62/238,688, entitled "SOUND SUPPRESSOR," filed on Oct. 7, 2015, which is herein incorporated by reference in its entirety.

FIELD

The disclosed embodiments are generally directed to sound suppressors, and more particularly to systems for suppressing sounds of a firearm.

BACKGROUND

Sound suppressors, also known as firearm silencers, are used to lower the level of sound generated when a firearm is discharged. As is known, sound suppressors work by trapping and delaying the exit of high pressure muzzle gasses released from the firearm when the firearm is discharged. Some sound suppressors create turbulences to enhance the trapping of muzzle gasses.

SUMMARY

According to one embodiment, a firearm sound suppressor is disclosed. The firearm sound suppressor includes shell and a core disposed within the shell, the core having a body with first and second stages. A diameter of the first stage is larger than a diameter of the second stage such that the second stage and the shell cooperate to provide greater gas expansion as compared to the cooperation of the first stage and the shell.

According to another embodiment, a firearm sound suppressor is disclosed. The firearm sound suppressor includes a shell a core disposed within the shell, the core having a body with first and second stages, a diameter of the first stage being larger than a diameter of the second stage, and an annular gap formed between an outer surface of the second stage of the core body and the shell.

According to yet another embodiment, a firearm sound suppressor is disclosed. The firearm sound suppressor includes a shell and a core disposed within the shell, the core having a body with first and second stages. A diameter of the first stage is larger than a diameter of the second stage. The core comprises one or more baffles that define one or more chambers, the one or more chambers having a serpentine arrangement.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION OF INVENTION

As is known, sound suppressors, also known as firearm silencers, are used to dampen the level of sound generated when the firearm is discharged. That is, a sound suppressor is attached to the end of a barrel of the firearm to trap and delay the exit of high pressure muzzle gasses released from the firearm during discharge. Some sound suppressors create turbulences, such as via a series of hollow chambers divided by baffles, to trap and delay the gasses within the suppressors. As the trapped gasses expand, travel, and cool through the baffles, the velocity and pressure of the gasses decreases, thus reducing the sound created by the firearm. Without wishing to be bound by theory, increasing the pressure-time relationship may create a delay in the gas exit and, thus, dampen the sound.

Applicant has realized that by creating additional turbulences, such as by increasing the volume for gas expansion (e.g., to further trap and delay the gasses), various advantages may be realized. For example, the suppressor may be able to accommodate firearms that discharge bullets at higher pressures (e.g., generating louder sounds) and/or may be able to better dampen the sounds of smaller firearms. For example, the suppressor may be configured to decrease the pressure of gasses entering the suppressor from about 6600 psi (e.g., 6624 psi) to about 200 psi (e.g., 194 psi) at about an inch away from an exit of the suppressor. As will be appreciated, after the gasses travel through the suppressor, the gas flow is reduced in speed and can flow other than in formal ratios to fill the air gaps. That is, the gas may not be supersonic.

However, balancing the need for a greater volume for gas expansion while creating a compact design that is relatively easy to manufacture and assemble is challenging. To that end, embodiments disclosed herein include a suppressor having an outer shell and a core. In one embodiment, the core has first and second stages. In some embodiments, the first stage is configured to slow the gas flow from a supersonic projectile and the second stage is used to further reduce the speed of the gas flow.

According to one aspect, the second stage has a smaller diameter than the diameter of the first stage, thus creating an annular air gap around the second stage and an increased volume for expansion of gasses. In some embodiments, the first stage has a larger diameter to maintain strength of the core at the proximal end of the suppressor (e.g., the firearm-end of the core) for absorbing energy generated during when the firearm is discharged. The core may include a baffle arrangement to trap gasses, the baffle arrangement defining a series of chambers having a serpentine configuration. In one embodiment, the core is a monolithic core (e.g., a single, machined and/or cast piece).

Figure 1:
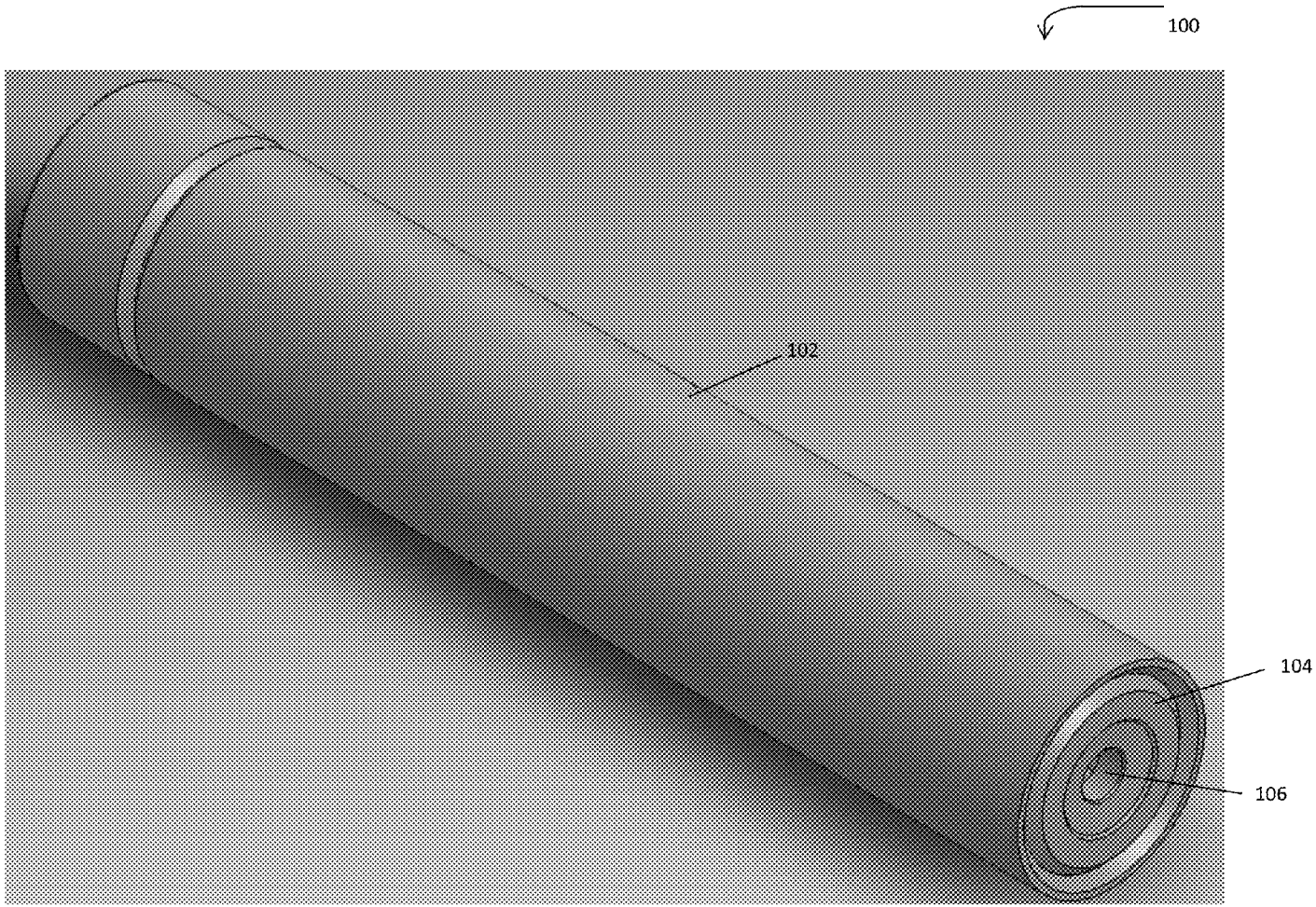
FIG. 1 is a perspective view of a suppressor according to one embodiment.
Figure 3:
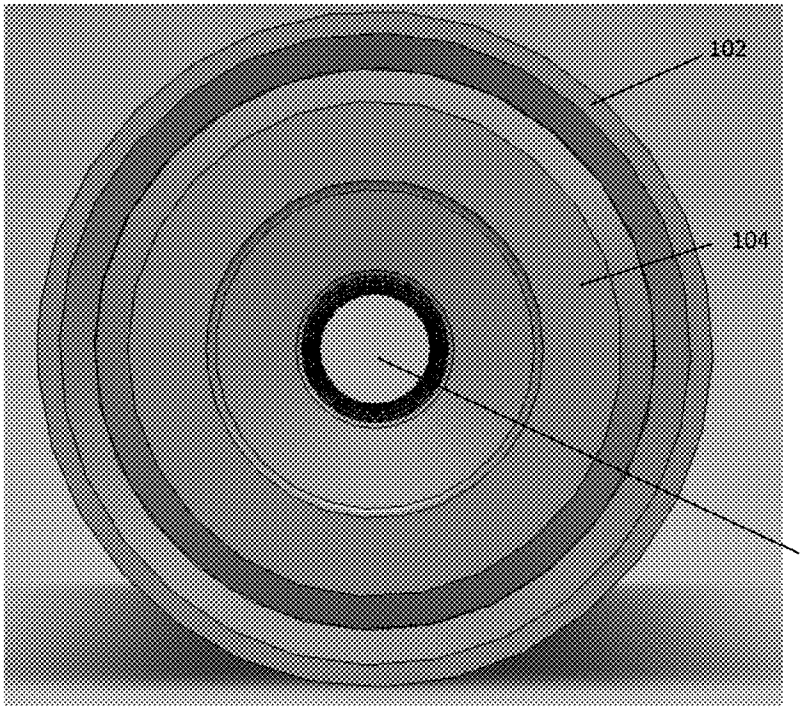
FIG. 3 is an exit-side view of the suppressor of FIG. 1.
Figure 2:
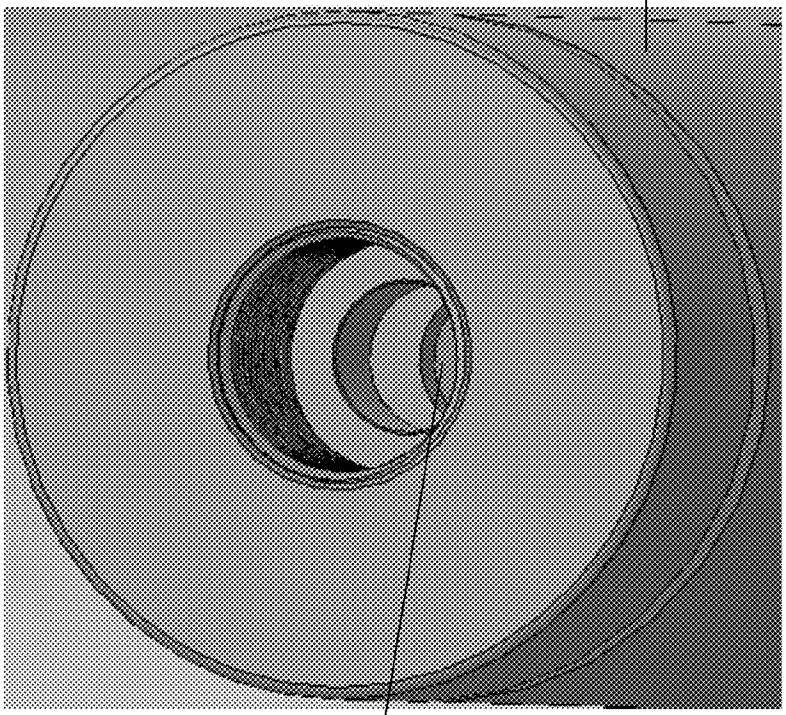
FIG. 2 is a firearm-side perspective view of the suppressor of FIG. 1.
Figure 4:
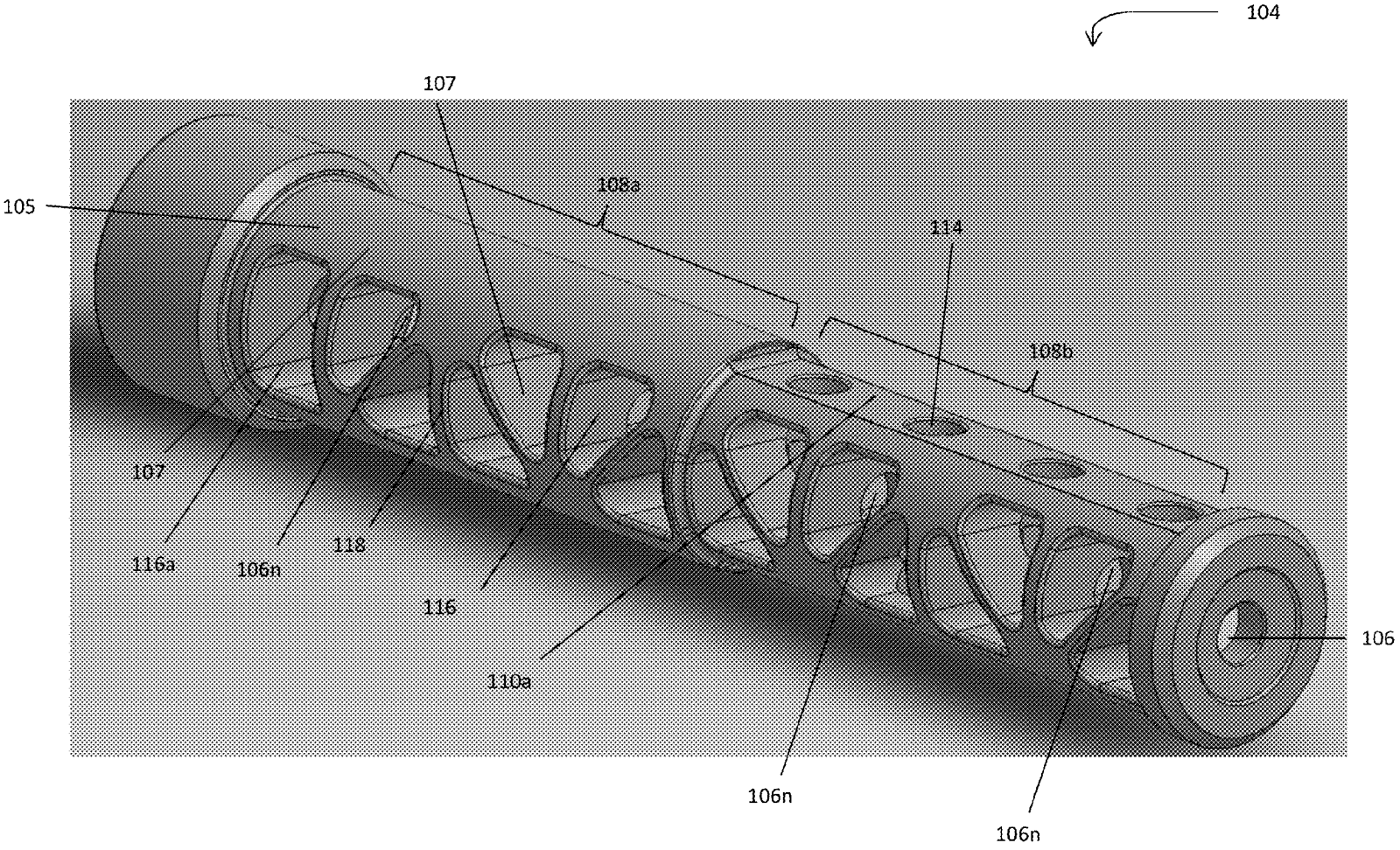
FIG. 4 is a perspective view of a core of a suppressor according to one embodiment.

Turning now to the figures, FIGS. 1-3 show a suppressor 100 according to one embodiment. As shown in FIGS. 1 and 3, the suppressor 100 includes a shell 102 and a core 104 at least partially disposed in the shell 102 (see FIG. 4 showing the core alone). The shell 102 may be a cylindrically-shaped tube, although other suitably shaped shells may be used (e.g., a shell having one or more cylindrical sections with different diameters, a hexagonal shaped shell, a loop shaped shell, or another suitably shaped shell). The core 104 includes a body 105 having an opening 106 through which a bullet passes when a firearm (not shown) is discharged. In some embodiments, the opening 106 is larger than the caliber bullet used. As will be appreciated, in such embodiments, the opening is larger than the bullet caliber to reduce or eliminate the risk that the bullet will strike the core when the firearm is discharged.

Figure 5:
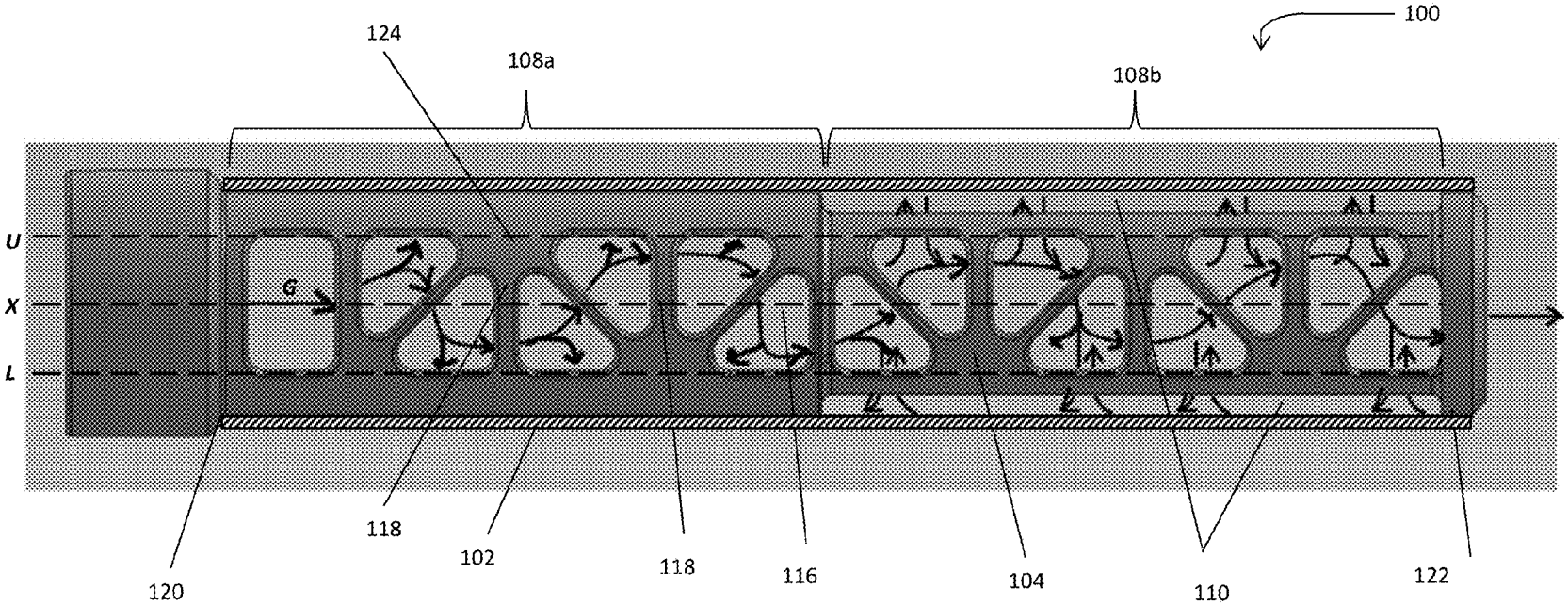
FIG. 5 is a front view of the core of FIG. 4, inside an outer shell that is shown in cross-section.
Figure 6:
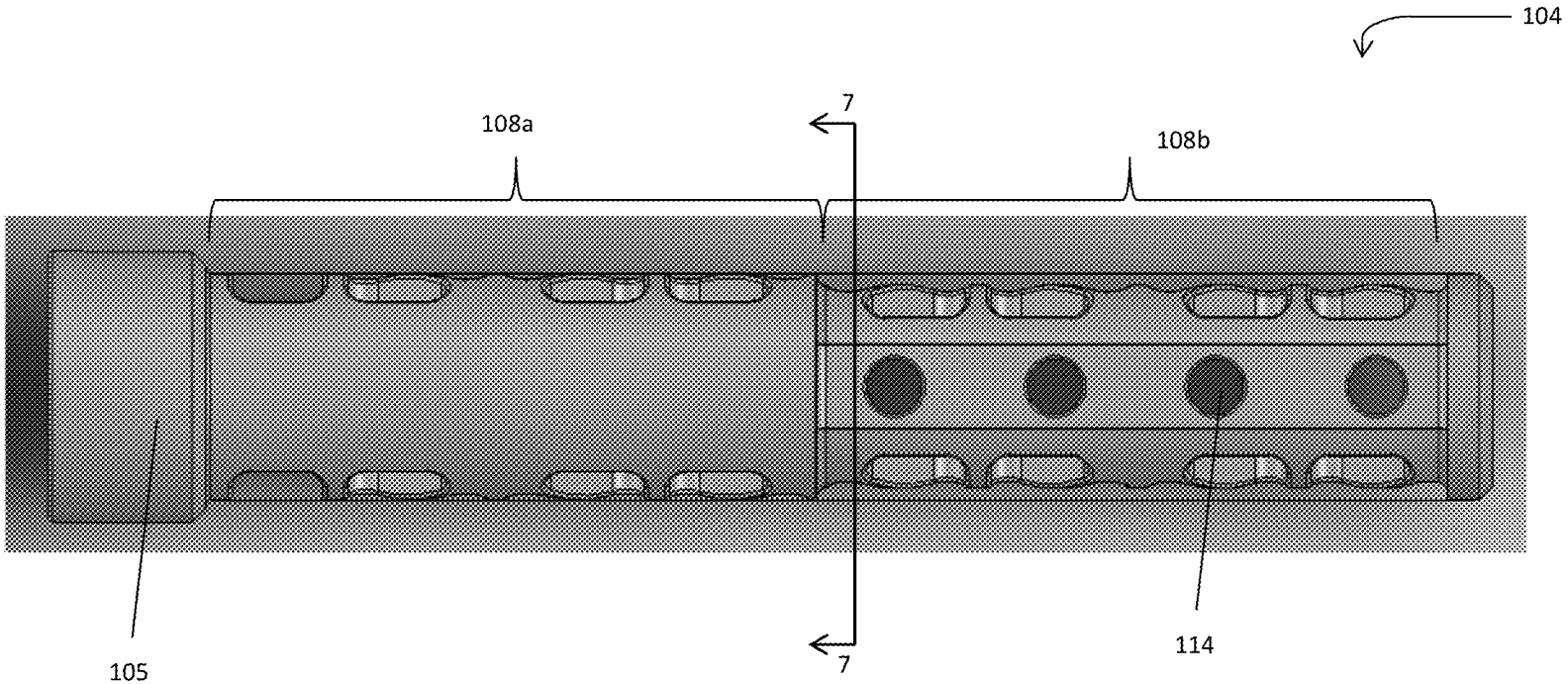
FIG. 6 is a top view of the core of FIG. 4.

FIGS. 4-6 show an embodiment of the core 104 according to one aspect. As illustrated in FIG. 4, the body 105 of the core 104 includes first and second stages 108*a*, 108*b* (e.g., first and second portions of the core body). In some embodiments, when the suppressor is attached to the firearm, the first stage is closest to the firearm (e.g., the first stage is on the firearm-side of the suppressor).

In some embodiments, as shown in FIGS. 4-5, when the core 104 is attached to the outer shell 102, the first stage 108*a* of the core body 105 rests generally flush against the inside surface of the shell 102 of the suppressor 100. That is, the outer surface 109 (see FIG. 4) of the first stage 108*a* of the core body 105 is positioned against the inner surface (not shown) of the shell 102. As will be appreciated, in such embodiments, little to no gas escapes between the first stage 108*a* (e.g., the outer wall of the first stage, which may have openings where the chambers 116 are located) and the shell 102 (e.g., the inner surface of the shell 102). Thus, the majority if not all of the gasses move through the first stage of the core to the second stage of the core.

Figure 7:
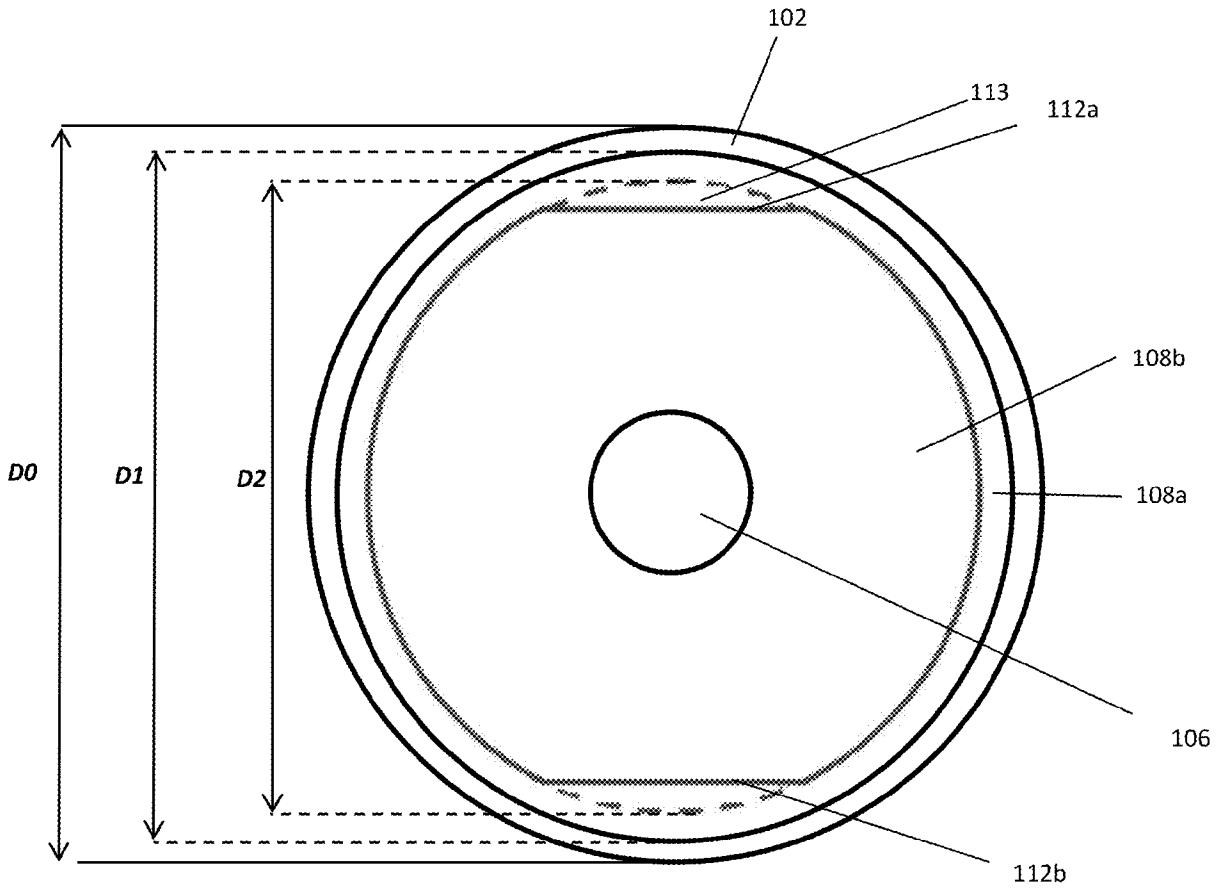
FIG. 7 is a cross-sectional side view of the core of FIG. 6 along line 7-7.

In some embodiments, the diameter of the first stage 108*a* is different from the diameter of the second stage 108*b*. For example, as shown in FIG. 7, the first stage 108*a* of the core body 105 may have a diameter D1 that is larger than the diameter D2 of the second stage 108*b* of the core body 105. In such embodiments, because the second stage 108*b* has a smaller diameter D2 than the diameter D0 of the shell 102 (e.g., and the first stage), an annular gap 110 (see FIG. 5) is formed between the second stage 108*b* of the core body 105 and the inner surface of the shell 102. As will be appreciated, the annular gap 110 (e.g., the space between the outer surface of the second stage 108*b* of the core body 105 and the inner surface of the outer shell 102) provides additional volume into which the gasses may expand and travel.

As will be appreciated, although the annular gap 110 is formed along an entire length of the second stage, in other embodiments, the annular gap may be formed along only a portion or along more than one portion of the second stage 108*b*. For example, in other embodiments, the second stage 108*b* may include two or more annular gaps (e.g., spaced along the length of the second stage 108*b*)

As will be further appreciated, although the core body is shown as having a smaller diameter in the second stage than in the first stage, in other embodiments the diameter of the first stage may be smaller than the diameter of the second stage. In such an embodiment, an annular air gap may be formed between the outer surface of the first stage and the inner surface of the outer shell.

In some embodiments, to further increase the volume of the annular gap 110 around the second stage 108*b*, the top and bottom outer surfaces 112*a*, 112*b* of the core body 105 in the second stage 108*b* are flat. The additional annular gap volume 113 created by the flat surfaces (e.g., as oppose to a cylindrically shaped second stage) is illustrated in FIG. 7.

As will be appreciated, although both the top and bottom outer surfaces of the second stage 108*b* of the core body 105 are shown as being flat, in other embodiments, only one outer surface may be flat or more than two outer surfaces may be flat. For example, the top, bottom, left and right outer surfaces of the second stage 108*b* may all be flat. As will be further appreciated, although an entire length of the top and bottom outer surfaces of the second stage 108*b* are shown as being flat, in other embodiments, only a portion of each outer surface may be flat. Also, although the outer surfaces are flat in these figures, other suitable geometries may be used to increase the annular gap around the second stage of the core body. For example, the surfaces may have another suitable shape (e.g. a triangular or hexagonal shape).

Without wishing to be bound by theory, if the diameter of the second stage 108*b* of the core body 105 becomes too small, the structural integrity and strength of the second stage 108*b* of the core body may be jeopardized. That is, a core body that is too narrow in the second stage may not be able to withstand the pressures generated when the bullet is discharged, making the suppressor unsafe for use.

In some embodiments, the diameter of the second stage 108*b* of the core body 105 is between about 0.5 inches and 1.25 inches smaller than the diameter of the shell 102. In some embodiments, the diameter of the second stage 108*b* of the core body 105 is between about 0.75 inches and 1.25 inches smaller than the diameter of the shell 102. In one embodiment, the diameter of the second stage of the core body is about 1.0 inches smaller than the diameter of the shell.

As shown in FIGS. 4 and 6, the top and bottom outer surfaces 112*a*, 112*b* of the core 104 have air openings 114 through which gasses may expand while traveling through the core 104. An example of the air travel through the air openings 114 and into and out of the annular air space is shown in FIG. 5. Although four air openings 114 are shown in these figures, it will be appreciated that the top and bottom surfaces may each have more or fewer air openings 114 in other embodiments. For example, the core body 105 could have five air openings on each of the top and bottom surfaces in another embodiment.

According to another aspect, as also shown in FIGS. 4-6, the core may induce turbulences in the gas flow. In some embodiments, this may be accomplished by forming hollow chambers in the core body (e.g., in the first and second stages). That is, the core may include a series of chambers 116 that are divided by baffles 118 (e.g., the walls in between the chambers). As will be appreciated, the chambers are in fluid communication with one another, with gasses traveling from a first chamber to a second chamber. The movement of gases through the various chambers is shown in by the arrows labeled G in FIG. 5.

In some embodiments (see FIG. 4), each of the baffle walls 118 includes an opening 106*n*, the openings 116*n* of all of the walls being aligned to form the opening 106 in the core body 105 through which the bullet is ejected from the suppressor.

As illustrated in FIGS. 4-6, in some embodiments, the core may include various configurations of the baffle walls. In some embodiments, the angles of the baffles may vary from baffle to baffle in the core body. The baffles also may have the same angle throughout the core body. As will be appreciated, the various baffle wall configurations create various chamber arrangements.

In some embodiments, the baffles are arranged such that the series of chambers has a serpentine configuration. For purposes herein, a serpentine configuration may mean that the series of chambers in the core body have a serpent-like or snakelike arrangement or may otherwise move in a winding path or line across the core body. For example, the chambers may be arranged such that the series of chambers appears to move up and down across the core bode. As will be appreciated, the serpentine configuration may be observed when looking at the series of chambers from a front view of the core, such as that seen in FIG. 5.

In some embodiments, as illustrated in FIG. 5, the core body includes a plurality of triangular-shaped chambers, which together create the serpentine configuration. In such a configuration, the orientation of the chambers and, thus, the angle of the baffles vary across the core body. For example, in the first stage 108*a*, the baffles are arranged at a +45° angle, a 90° angle, a −45° angle, a 90° angle and a +45° angle, respectively. In the second stage 108*b*, the baffles are arranged at −45° angle, a 90° angle, a +45° angle, a 90° angle, a −45° angle, a 90° angle, and a +45° angle, respectively.

In some embodiments, the triangular-shaped chambers are offset with respect to a centerline X of the core. That is, for some chambers, a greater volume of each chamber is positioned above the center line X, while for other chambers, a greater volume of each chamber is positioned below the centerline X. As illustrated in FIG. 5, all of the chambers with a greater volume above the centerline intersect an upper line U of the core and all of the chambers with a greater volume below the center line intersect a lower line L of the core. However, as further illustrated in FIG. 5, none of the triangular-shaped chambers extend to both the upper and lower lines U, L of the core. As will be appreciated, in other embodiments, the triangular-shaped chambers may be configured such that they extend between the upper and lower lines of the core.

As also shown in FIG. 5, the serpentine configuration may be formed by creating a hub and spoke arrangement of the baffles, with some of the hubs 124 being positioned above the center line X and some of the hubs 124 being positioned below the center line X. In some embodiments, the baffles 118 extend radially from the hub 124. In such embodiments, the baffles may extends radially at a +45° angle, a 90° angle, and a −45° angle.

Although the first and second stages are both shown as having the same number of hubs, it will be appreciated that the number of hubs per stage may vary. Also, while each stage is shown as having 2 hubs, in other embodiments, each stage may include only one hub or may include more than 2 hubs. Additionally, although the first stage is shown as having a first hub positioned above the center line and a second hub positioned below the centerline, and the second stage is shown as having both hubs positioned below the center line, the position of the hubs with respect to the centerline may vary in each stage while still maintaining the serpentine configuration of the chambers.

As will be appreciated, although the baffles are arranged at 45° and 90° angles, in other embodiments, other angles may be used to create the turbulences in the core body. That is, chambers having shapes other than the shown triangular-shaped chambers may be used in other core bodies. For example, the chambers may be square, rectangular, oval, or another suitable shape. As will be further appreciated, the shapes of the chambers in the first stage maybe different from the shape of the chambers in the second stage. That is, while triangular-shaped chambers may be used in the first chamber, circular-shaped chambers may be used in the second stage.

As shown in FIGS. 4-5, in some embodiments, the core body includes a first expansion chamber before the serpentine configuration. In such embodiments, the first expansion chamber may include a substantially rectangular shape with a vertical first baffle. As shown in FIG. 5, the rectangular-shaped chamber extends between the upper and lower lines U, L of the core body 105. In some embodiments, the first, vertical baffle may serve as a blast wall. That is, the first expansion chamber (along with the rest of the first stage) may be configured to absorb the energy released by the firearm during discharge.

In some embodiments, the baffle walls may be the same thickness across the core body, although the baffle walls also may have thickness that vary from baffle to baffle. The baffles also may have any suitable shape (e.g., a flat or curved surface) to encourage the gasses to travel and delay in the chambers.

In some embodiments, the first and second stages may have the same number of baffles. In other embodiments, as shown in FIGS. 4-6, the first stage 108*a* also may have a different number of baffles than the second stage 108*b*.

In some embodiments, because the second stage has diameter that is less than than the diameter of the first stage, the volume of the chambers in the second stage may be less than the volume of the chambers in the first stage. However, as will be appreciated, the second stage also may be configured such that the chambers have the same volume as the chambers in the first stage. For example, in such an embodiment, the thickness of the baffle walls and/or the thickness of outer walls of the second stage of the core body may be varied to create chambers having the same size (e.g., volume) as that of the chambers in the first stage.

In some embodiments, the core is a monolithic core. That is, the core may be a single piece as opposed to being formed from one or more cores bodies. For example, in one embodiment, the suppressor may be formed by gun drilling a solid piece of metal (e.g., steel or aluminum). The core also may be formed via casting. As will be appreciated, a monolithic core may make the suppressor stronger and better able to maintain strength in the first stage of the suppressor (e.g., the proximal end of the suppressor) when the firearm is discharged. In other embodiments, the suppressor (e.g., the core) may be made of one or more parts and/or one or more types of materials. For example, in some embodiments, the baffles may be made of a different material than the rest of the core, although it may be made out of the same material.

In some embodiments, the suppressor 100 is formed by welding together the outer shell 102 and the core 104. For example, the core may be held to the shell by a first perimeter weld formed where the suppressor attaches to a firearm (e.g., at the firearm side) and a second free weld at the end of the suppressor (e.g., the exit end of the suppressor). In one embodiment, as shown in FIG. 5, the outer shell 102 may be attached to the core 104 at a first collar 120, adjacent the first stage 108*a*, and a second collar 122, adjacent the second stage 108*b*. As will be appreciated, other attachment mechanisms may be used to join the core 104 and the outer tube 102. For example, in some embodiments, the core 104 and outer tube 102 may be coupled by threading one to the other. In such embodiments, either the core 104 or the outer tube 102 may include a screw that is coupled with threads on the outer tube 102 or core 104, respectively.

Although the suppressor is shown and described as having an outer shell 102 with a constant diameter and core having two stage with different diameters (e.g., the second stage having a smaller diameter and an annular air gap), it will be appreciated that other suitable arrangements for forming an annular gap around the second stages may be possible. For example, in one embodiment, the core may have a uniform diameter with the outer shell having first and second stages, the second stage of the outer shell having a larger diameter than the diameter of the first stage of the outer shell. In such an embodiment, the core may still lay generally flush against the outer shell in the first stage, with a annular gap being formed between the core and the second stage of the outer shell. In some embodiment, as with other embodiments, the top and bottom outer surfaces of the core may be flat to increase the annular air gap in this second stage.

As will be appreciated, the suppressor may be configured to muffle the sound of any firearm (e.g., a handgun and/or a rifle). That is, the suppressor may be sized and shaped to work with any type of firearm.

Although the suppressor is shown as having a core with two stages having different diameters, in other embodiments, the suppressor may have more than two stages. For example, in another embodiment, the core body may have first, second and third stages, with first, second and third, diameters, respectively. As will be appreciated, the diameter of the third stage may be smaller than the first and second diameters (e.g., the core becomes increasingly narrower as it moves further away from the firearm). Other combinations of diameters also may be used in other embodiments.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A firearm sound suppressor comprising:

a shell having an inner surface and a constant inner diameter; and a core disposed within the shell and extending from a first end of the shell to a second end of the shell, the core having a body consisting essentially of first and second stages, the first stage being adjacent to a barrel of a firearm when the suppressor is attached to the firearm, an outer surface of the first stage directly engaging with the inner surface of the shell along an entire length of the first stage, and an outer surface of the second stage being spaced from the inner surface of the shell;

wherein the first stage includes one or more baffles that define one or more chambers, at least one of the one or more baffles in the first stage being angled at a non-perpendicular angle relative to the core body;

wherein the second stage includes one or more baffles that define one or more chambers, at least one of the one or more baffles in the second stage being angled at a non-perpendicular angle relative to the core body;

wherein an outermost diameter of the first stage of the core body is larger than an outermost diameter of the second stage of the core body such that the second stage and the shell cooperate to provide greater gas expansion as compared to the cooperation of the first stage and the shell;

wherein an annular air gap is formed in the entirety of the space between the outer surface of the second stage of the core body and the inner surface of the shell.

2. The firearm sound suppressor of claim 1, wherein an angle of the at least one baffle in the first stage is different than an angle of the at least one baffle in the second stage.

3. The firearm sound suppressor of claim 1, wherein the second stage comprises one or more openings arranged to transfer gasses into the annular gap.

4. The firearm sound suppressor of claim 1, wherein one or more portions of the outer surface of the second stage is flat.

5. The firearm sound suppressor of claim 1, wherein the core includes an opening arranged to eject a bullet.

6. The firearm sound suppressor of claim 1, wherein the one or more chambers in the first stage are in fluid communication with the one or more chambers in the second stage.

7. The firearm sound suppressor of claim 1, wherein the one or more baffles in the first stage are arranged such that the one or more chambers in the first stage have a serpentine arrangement.

8. The firearm sound suppressor of claim 7, wherein the one or more baffles in the second stage are arranged such that the one or more chambers in the second stage have a serpentine arrangement.

9. The firearm sound suppressor of claim 1, wherein at least a second baffle of the one or more baffles in the first stage includes a vertical baffle, and at least a second baffle of the one or more baffles in the second stage includes a vertical baffle.

10. The firearm sound suppressor of claim 9, wherein the at least one baffle in the second stage is arranged at one of a +45° angle and a −45° angle.

11. The firearm sound suppressor of claim 1, wherein the at least one baffle in the first stage is arranged at one of a +45° angle and a −45° angle, and the at least one baffle in the second stage is arranged at one of a +45° angle and a −45° angle.

12. The firearm sound suppressor of claim 1, wherein the first stage comprises a first chamber at a proximal end, the first chamber being defined by a vertical baffle wall.

13. The firearm sound suppressor of claim 1, wherein the core is attached to the shell.

14. The firearm sound suppressor of claim 1, wherein the core comprises a monolithic core.

15. A firearm sound suppressor comprising:

a shell having an inner surface;

a core disposed within the shell and extending from a first end of the shell to a second end of the shell, the core having a body consisting essentially of first and second stages, the first stage being adjacent to a barrel of a firearm when the suppressor is attached to the firearm, an outer surface of the first stage directly engaging with the inner surface of the shell, wherein a distance between a center of the core body and an outermost portion of the core body in the first stage is larger than a distance between the center of the core body and an outermost portion of the core body in the second stage, wherein the first stage includes one or more baffles that define one or more chambers, at least one of the one or more baffles in the first stage being angled at a non-perpendicular angle relative to the core body, wherein the second stage includes one or more baffles that define one or more chambers, at least one of the one or more baffles in the second stage being angled at a non-perpendicular angle relative to the core body; and an annular air gap formed in the entirety of the space between an outer surface of the second stage of the core body and the inner surface of the shell, wherein the outer surface of the second stage does not contact the shell.

16. The firearm sound suppressor of claim 15, wherein the second stage comprises one or more openings arranged to transfer gasses into the annular gap.

17. The firearm sound suppressor of claim 15, wherein one or more portions of the outer surface of the second stage is flat.

18. The firearm sound suppressor of claim 15, wherein the one or more baffles in the first stage are arranged such that the one or more chambers in the first stage have a serpentine configuration, and the one or more baffles in the second stage are arranged such that the one or more chambers in the second stage have a serpentine configuration.

19. The firearm sound suppressor of claim 15, wherein the one or more chambers in the first stage are in fluid communication with the one or more chambers in the second stage, wherein the first stage comprises a first chamber at a proximal end, the first chamber being defined by a vertical baffle wall.

20. The firearm sound suppressor claim 15, wherein the core is attached to the shell via a collar at a first end of the core that is attachable to the first end of the shell and a collar at a second end of the core that is attachable to the second end of the shell.

21. The firearm sound suppressor of claim 15, wherein the core is a monolithic core.

22. The firearm sound suppressor of claim 15, wherein an angle of the at least one baffle in the first stage is different than an angle of the at least one baffle in the second stage.

23. The firearm sound suppressor of claim 15, wherein the at least one baffle in the first stage is arranged at one of a +45° angle and a −45° angle, and the at least one baffle in the second stage is arranged at one of a +45° angle and a −45° angle.

24. A firearm sound suppressor comprising:

a shell; and a core disposed within the shell and extending from a first end of the shell to a second end of the shell, the core having a body consisting essentially of first and second stages, the first stage being adjacent to a barrel of a firearm when the suppressor is attached to the firearm, an outer surface of the first stage directly engaging with an inner surface of the shell along an entire length of the first stage, wherein the first stage includes one or more baffles defining one or more chambers, a first chamber in the first stage being defined by a vertical baffle and a second chamber in the first stage being defined by an angled baffle, wherein the second stage includes one or more baffles defining one or more chambers;

wherein a distance between a center of the core body and an outermost portion of the core body in the first stage is larger than a distance between the center of the core body and an outermost portion of the core body in the second stage;

wherein the distance between the center of the core body and the outermost portion of the core body in the first stage is constant along a length of the first stage and the distance between the center of the core body and the outermost portion of the core body in the second stage is constant along a length of the second stage;

wherein the one or more chambers in the first stage and the one or more chambers in the second stage have a serpentine arrangement.

25. The firearm sound suppressor of claim 24, wherein the angled baffle of the first stage is arranged at one of +45° angle and a −45° angle.

26. The firearm sound suppressor of claim 24, wherein the first chamber is located at a proximal end of the first stage.

27. The firearm sound suppressor of claim 24, wherein the core is attached to the shell via a collar at a first end of the core that is attachable to the first end of the shell and a collar at a second end of the core that is attachable to the second end of the shell.

28. The firearm sound suppressor of claim 24, wherein the core is a monolithic core.

29. The firearm sound suppressor of claim 24, wherein the second stage comprises one or more openings arranged to transfer gasses into an annular gap formed between an outer surface of the core body in the second stage and the shell.

30. The firearm sound suppressor of claim 24, wherein at least one of the one or more baffles in the second stage is angled relative to the core body.

* * * * *